United States Patent [19]

Arild

[11] Patent Number: 4,498,656

[45] Date of Patent: Feb. 12, 1985

[54] UNIVERSAL MECHANICAL LINKAGE

[76] Inventor: Tor Arild, 76 Morse La., Woodside, Calif. 94062

[21] Appl. No.: 461,945

[22] Filed: Jan. 28, 1983

Related U.S. Application Data

[63] Continuation of Ser. No. 207,132, Nov. 17, 1980, abandoned.

[51] Int. Cl.[3] ..... F16M 13/00

[52] U.S. Cl. ..... 248/608; 248/188.1

[58] Field of Search ..... 248/608, 188.7, 590, 248/188.1; 297/302, 303; 267/133, 154, 160; 403/347, 346, 396; 464/100, 101

[56] References Cited

U.S. PATENT DOCUMENTS

| | | | |
|---|---|---|---|
| 1,332,962 | 3/1920 | Tibbetts . | |
| 2,116,195 | 5/1938 | Foster . | |
| 2,119,946 | 6/1938 | Bancroft | 248/188.7 |
| 2,155,234 | 4/1939 | Meisse | 248/626 X |
| 2,269,968 | 1/1942 | Baker | 248/627 X |
| 3,188,033 | 6/1965 | Groves | 248/188.7 |
| 3,512,419 | 5/1970 | Stiles . | |
| 3,544,159 | 12/1970 | Andersson | 297/303 |
| 3,895,771 | 7/1975 | Baum | 248/188.7 |
| 4,185,803 | 1/1980 | Kalvatn | 248/608 |
| 4,236,752 | 12/1980 | Mizelle | 297/303 |

FOREIGN PATENT DOCUMENTS

| | | | |
|---|---|---|---|
| 649142 | 12/1928 | France . | |
| 853804 | 3/1940 | France . | |
| 217011 | 6/1924 | United Kingdom | 248/608 UX |
| 1265035 | 3/1972 | United Kingdom | 248/608 |

*Primary Examiner*—J. Franklin Foss

*Attorney, Agent, or Firm*—Limbach, Limbach & Sutton

[57] ABSTRACT

A universal joint suspension element has four torsion arms, extending from a central location, forming a substantially planar member. Clamping means with a plurality of grooves fasten the member. The grooves are patterned such that the torsion arms are secured therein, with the grooves flared near the periphery of the clamping means.

11 Claims, 13 Drawing Figures

UNIVERSAL MECHANICAL LINKAGE

This is a continuation of application Ser. No. 207,132, filed Nov. 17, 1980, now abandoned.

BACKGROUND OF THE INVENTION

The present invention relates to a universal joint suspension element and more particularly to a universal mechanical linkage for connection between a first movable body, such as a seat portion of a chair, and a second movable body, such as a support column or base portion of a chair.

Universal joints are well known in the art. In general, a universal joint is a shaft coupling which is capable of transmitting rotational movement from one shaft to another not colinear with it. The joint typically comprises a planar member having four rigid arms extending from a central point (commonly called a spider), wherein the arms form a pattern of two lineal bars which are substantially perpendicular to one another. The ends of the two rigid arms that form one of said lineal bars are connected by bearings to a U-shaped element which is adapted to be connected to one of the rotational shafts. The other two ends of the other two rigid arms that form the second lineal bar are also connected by bearings to a second U-shaped element which is driven by a second rotational shaft. Thus, the rotational coupling from one shaft to another not colinear with it is achieved.

U.S. Pat. No. 3,512,419 discloses another form of universal joint suspension element for use in free-rotor displacement type gyros. That patent teaches the use of torsion arms that can flex and twist instead of rigid arms. However, that patent discloses a universal joint having only two degrees of freedom. Moreover, as disclosed in that patent as a desired characteristic, the element has the characteristic of high angular compliance and extreme rigidity.

The use of a mechanical linkage in a system whereby two mutually movable members are present, such as a seat portion and a base portion of a chair, is disclosed in U.S. Pat. No. 4,185,803. That patent, however, teaches the use of concentric rings and torsion bars. The use of such rings unduly complicates the system and adds to the cost thereof.

SUMMARY OF THE INVENTION

Therefore, in accordance with the present invention, a universal joint suspension element has a substantially planar member which has four torsion arms extending from a central location whereby the arms form a pattern of two lineal bars intersecting one another. Means are provided, securely fastening the arms at the central location. The means is characterized by a flared portion in the periphery of said means near where said arms extend from said means.

The present invention also provides for the use of said universal joint for connection between a first movable body, such as the base portion of a chair, and a second movable body, such as the seat portion of a chair.

BRIEF DESCRIPTION OF THE INVENTION

DETAILED DESCRIPTION OF THE PRESENT INVENTION

Figure 1:
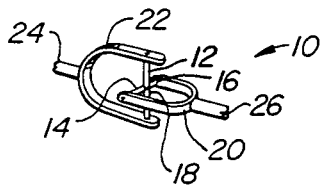
PRIOR ART FIG. 1.
FIG. 1 is a perspective view of a universal joint of the prior art.

Referring to FIG. 1, there is shown a universal joint 10 of the prior art. The universal joint 10 of the prior art comprises a first rigid arm 12, a second rigid arm 14, a third rigid arm 16, and a fourth rigid arm 18, all extending from a central location. The arms 12, 14, 16, and 18 form a pattern of two lineal bars that are substantially perpendicular to one another. One bar is formed by joining the first rigid arm 12 with the third rigid arm 18. A second bar is formed by joining the second rigid arm 14 with the fourth rigid arm 16. The ends of the first bar, formed by the first and third rigid arms 12 and 18 respectively, are connected by bearings to a first U-shaped element 22. The first U-shaped element 22 is connected to a first shaft 24. The ends of the second bar formed by the joining of the second and fourth rigid arms 14 and 16 respectively, are connected also by bearings to a second U-shaped element 20. The second U-shaped element 20 is connected to a second shaft 26.

Figure 2:
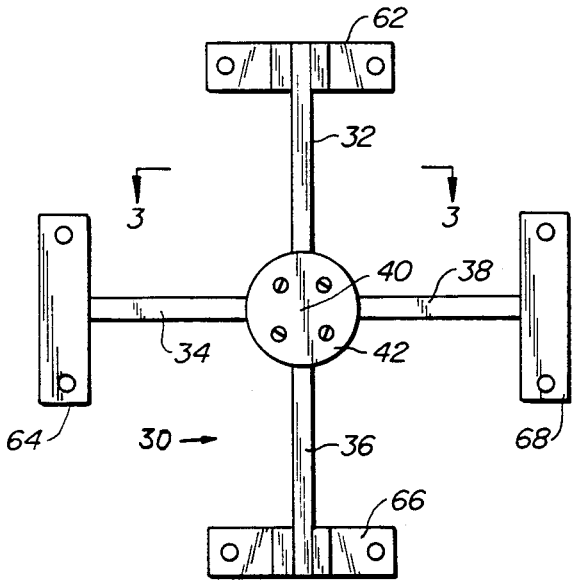
FIG. 2 is a top view of the universal joint of the present invention.

Referring to FIG. 2, there is shown a universal joint 30 of the present invention. The universal joint 30 comprises a first torsion arm 32, a second torsion arm 34, a third torsion arm 36, and a fourth torsion arm 38 all extending from a central location 40. The first, second, third, and fourth torsion arms 32, 34, 36, and 38 respectively, form a pattern of two lineal bars that are substantially perpendicular to one another. As will be shown hereinafter, the first and third torsion arms 32 and 36 respectively, may be of unitary construction, while the second and fourth torsion arms 34 and 38 may be of a second unitary member. Each of the torsion arms 32, 34, 36 and 38 is of the same size and shape and is substantially in the shape of a rectangular solid. However, as will be shown hereinafter, the shape or the size of the torsion arms 32, 34, 36 or 38 may vary and will still be within the scope of this invention. The four torsion arms form a substantially planar member. A pair of central clamps 42 and 44, with one of said clamps on each side of the plane formed by the torsion arms, securely fasten the torsion arms between the central clamps. Each of the central clamps 42 and 44 is identical in size and shape and is substantially cylindrically shaped. Each of the central clamps is immediately adjacent the other with the intersection of the torsion arms, i.e., central location 40 therebetween.

Figure 4:
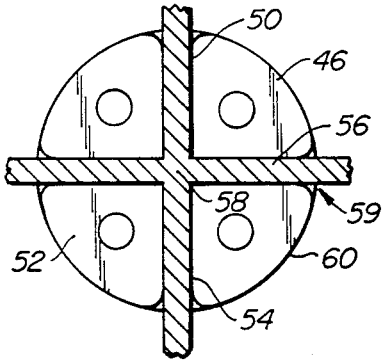
FIG. 4 is a cross-sectional view of a portion of the universal joint of the present invention taken along the lines 4—4.
Figure 3:
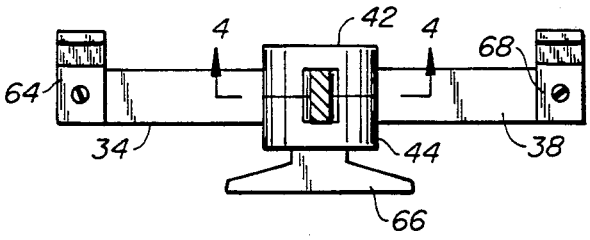
FIG. 3 is a cross-sectional view of the universal joint of the present invention taken along the lines 3—3.

Referring to FIG. 4, there is shown a cross-sectional view of the central clamp 42. The central clamp 42 is characterized by a surface 46, which is substantially flat, having four grooves therein, the first groove 50, second groove 52, third groove 54 and fourth groove 56. The grooves 50, 52, 54, and 56 also extend from a central location 58 to the periphery 60 of the clamp 42. The grooves are patterned such that the torsion arms 32, 34, 36 and 38 are secured in the grooves 50, 52, 54, and 56 respectively. Each of the grooves is flared outward 59 near the periphery 60 of the clamp. Four screws fasten the clamps 42 and 44 with the torsion arms therebetween. At the end of each torsion arm 32, 34, 36 and 38, there is a bridge 62, 64, 66, and 68 respectively. The first bridge 62 and the third bridge 66 are designed to be connected to a first movable body (not shown). The second and fourth bridges 64 and 68 respectively are designed to be connected to a second movable body (not shown). In this manner, the universal joint 30 may be connected between a first movable body and a second movable body.

Figure 5:
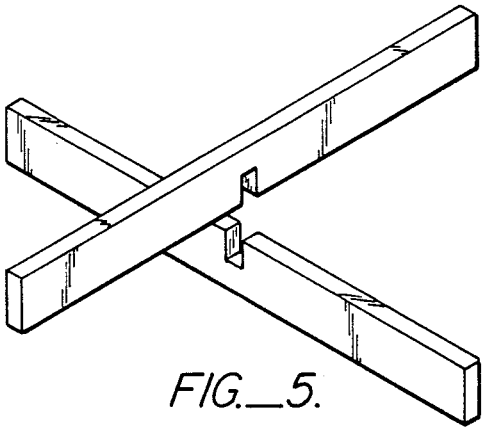
FIG. 5 is an exploded perspective view of a portion of the universal joint of the present invention, showing the construction of that portion thereof.

Referring to FIG. 5, there is shown a pair of rectangular springs. Each of the rectangular springs is notched in the middle, so that when the springs are assembled, all four edges of the spring are coplanar. In this manner, the four torsion arms of the universal joint 30 may be constructed. While the universal joint 30 has been described as having torsion arms that are substantially rectangular solid in shape, it should be clear that the torsion arms need not be so limited in the size or shape. In particular, the torsion arms may be cylindrically shaped, or square, or even tubularly shaped.

Figure 6:
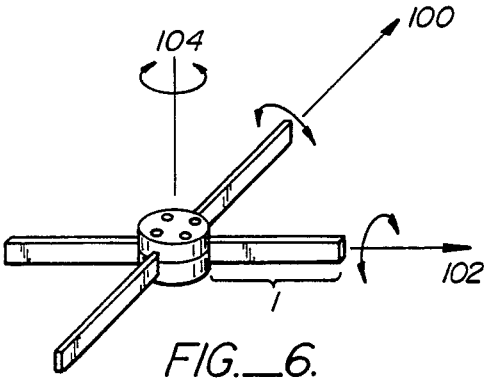
FIG. 6 is a perspective view of the universal joint of the present invention showing its three degrees of freedom.

There are many advantages of the universal joint of the present invention. First, unlike the universal joint as disclosed in U.S. Pat. No. 3,512,419, which has only two degrees of freedom, the universal joint 30 of the present invention has three degrees of freedom. As can be seen in FIG. 6, the universal joint 30 of the present invention may be rotated about the axes 100, 102, and 104. In contrast, the universal joint, as disclosed in U.S. Pat. No. 3,512,419, has rotational freedom only about the axes 100 and 102. Secondly, the spring rate of the universal joint 30 of the present invention may be varied by varying the size of the central clamp 42 and 44. In general, the spring rate of the joint 30 is determined by the characteristic of the material used, the free length, the free width and the free thickness. In the universal joint 30 of the present invention, once the torsion arms have been chosen, the material is set, the width is determined, and the thickness cannot be changed. The free length, however, is the distance L between the periphery 60 of the central clamp 42 and the bridge which connects the universal clamp to the movable body. By varying the size of the central clamp, the free length L may be varied. Thus, the spring rate of the universal joint 30 of the present invention may be varied with considerable ease by simply changing the size of the central clamp 42 or 44. Thirdly, because the grooves of the central clamp are flared near the periphery of the central clamp, this assures that there are no sharp stress concentration points where the torsion arms must flex or twist. This insures a longer life of operation of the universal joint 30.

Figure 7:
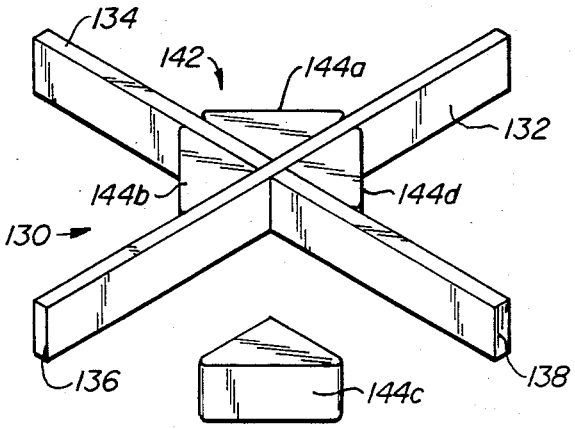
FIG. 7 is a perspective view of another embodiment of the present invention.
Figure 8:
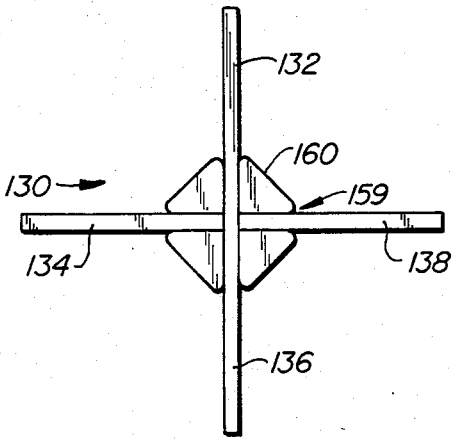
FIG. 8 is a top view of the embodiment of FIG. 7.

Referring to FIGS. 7 and 8 there is shown another embodiment of the present invention. The universal joint 130 comprises a first, second, third and fourth torsion arms 132, 134, 136 and 138 respectively. As previously discussed, the first and third torsion arms 132 and 136 may be a unitary member while the second and fourth torsion arms 134 and 138 may also be a unitary member. The joint 130 further comprises a clamping means 142 which is comprises of four clamp pieces 144*a*, 144*b*, 144*c* and 144*d*. Each of the clamp pieces 144 has a flared portion 159 near the periphery 160 where the arms extend from the means 142. Each clamp piece 144 is between two immediately adjacent torsion arms and may be welded or suitably fastened to the adjacent torsion arms.

Figure 9:
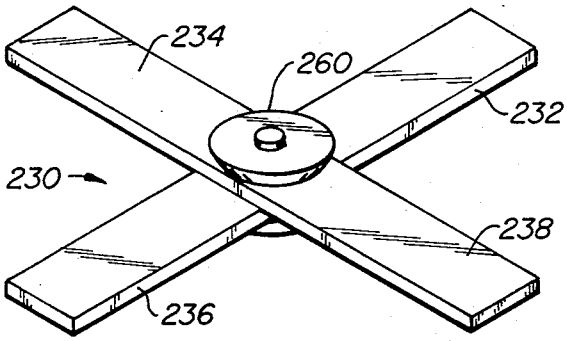
FIG. 9 is a perspective view of yet another embodiment of the present invention.
Figure 10:
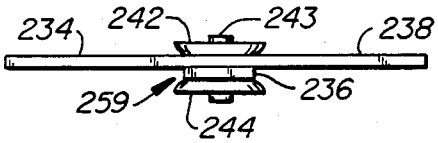
FIG. 10 is a side view of the embodiment of FIG. 9.

Referring to FIGS. 9 and 10 there is shown yet another embodiment of the universal joint of the present invention. The universal joint 230 comprises a first, second, third and fourth torsion arms 232, 234, 236 and 238 respectively. A pair of clamping means 242 and 244 are on opposite sides of the plane defined by the torsion arms 232, 234, 236 and 238. Each of the clamping means is characterized by a flared portion 259 near the periphery 260. A screw 243 fastens the clamping means with the torsion arms therebetween.

Figure 11:
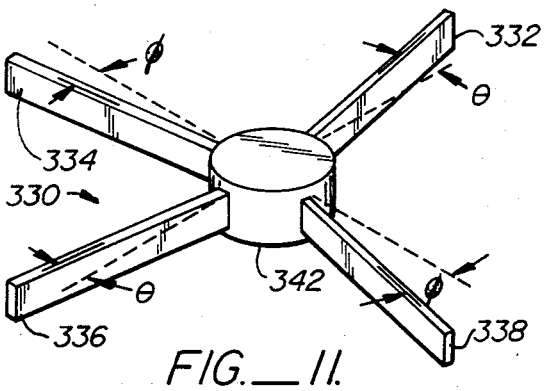
FIG. 11 is a schematic view of still another embodiment of the present invention.

In FIG. 11 there is shown another embodiment of the present invention. The universal joint 330 shown in FIG. 11 comprises four torsion arms and clamping means that are exactly like that shown in FIG. 2 except the torsion arms 332, 334, 336 and 338 are not exactly coplanar with one another. However, the torsion arms do form a substantially planar member. The angle of deviation $\theta$ and $\phi$ from the plane of the universal joint 330 is small. Typically, it is on the order of less than 15°. Such a joint may be useful for coupling connections where additional clearance is required at the intersection of the two torsion bars, or where it is desired to provide a softer spring rate where peripheral space is restricted.

Figure 12:
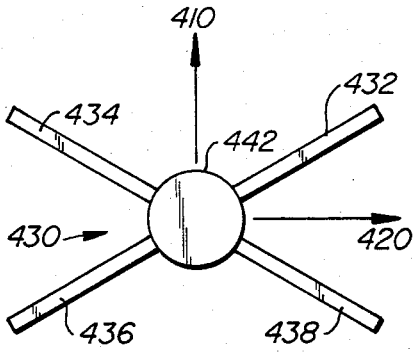
FIG. 12 is a schematic view of still yet another embodiment of the present invention.

FIG. 12 shows still another embodiment of the universal joint 430 of the present invention. In this embodiment the first and third torsion arms 432 and 436 are not perpendicular to the second and fourth torsion arms 434 and 438. In this embodiment the joint 430 is stiffer along the axis 420 than along the axis 410. Thus, variation in the degree of stiffness of flexibility may be varied along various axis by changing the angular displacement between adjacent torsion bars.

Figure 13:
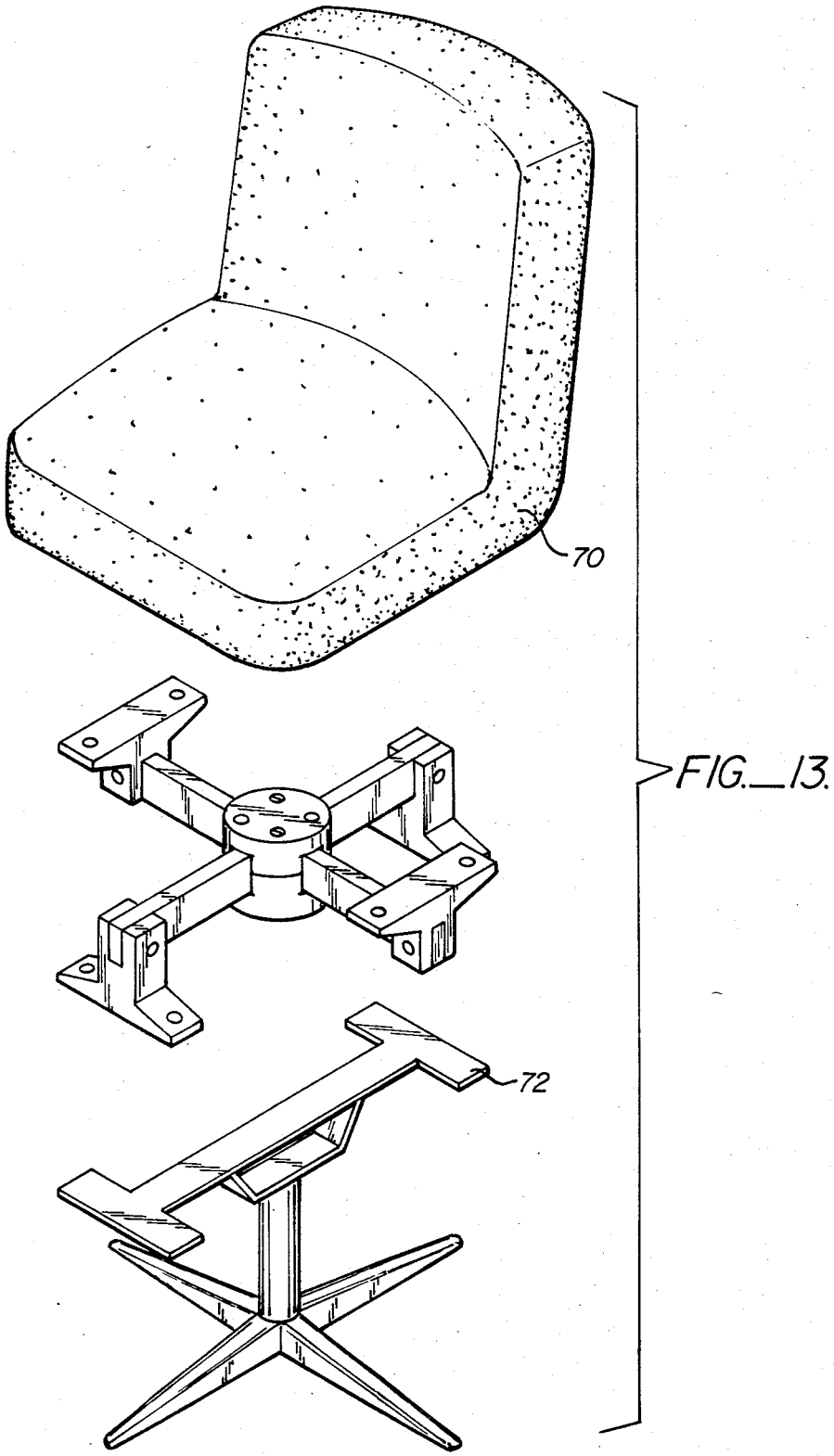
FIG. 13 is an exploded perspective view of the use of the universal joint of the present invention in a chair.

Referring to FIG. 13, there is shown one application of the universal joint 30 of the present invention. In this example, the first and third bridges, 62 and 66, are connected to a seat portion 70 of a chair while the second and fourth bridges 64 and 68 are connected to a base portion 72 of a chair. A chair having such a mechanical linkage between the seat portion 70 and the base portion 72 would have 3 degrees of freedom and in addition would be easier to construct than the pivotal adjustment as disclosed in U.S. Pat. No. 4,185,803. Of course, there are many applications of the universal joint 30 of the present invention other than use in a chair or a seat. Other examples include the use of the joint as an engine mount, as a shock and vibration isolator for masts, towers, and cranes as well as for coupling between two rotatable shafts, such as drive shafts.

What is claimed is:

1. A torsioned linkage element for interconnecting and supporting a first movable body with respect to a second movable body, said element comprising:

first and second lineal bars, said bars being substantially coplanar and intersecting one another at a central location with the opposed free ends of said first bar being connectable to said first movable body and with the opposed free ends of said second bar being connectable to said second movable body;

first means for rigidly connecting at least one free end of said first bar to said first movable body;

second means for rigidly connecting at least one free end of said second bar to said second movable body; and clamping means for securely fastening said bars at said central location, said bars being configured such that said linkage element is capable of motion in three axes whereby said linkage element provides support and torsionally restrained relative motion between said bodies in all axes.

2. A linkage element as recited in claim 1 wherein said clamping means is characterized by an inwardly flared portion at the periphery of said means near where said bars extend from said means.

3. A linkage element as recited in claim 1 wherein said bars are substantially in the shape of a rectangular solid.

4. A linkage element as recited in claim 1 wherein said lineal bars are substantially perpendicular to one another.

5. A linkage element as recited in claim 1 wherein said clamping means comprises a pair of clamp members disposed on each side of said lineal bars, each said clamp member having a pair of grooves for receiving said lineal bars.

6. A linkage element as recited in claim 5 wherein said clamp members are substantially cylindrically shaped.

7. A torsioned linkage element for interconnecting and supporting a first movable body with respect to a second movable body, said element comprising:

first and second lineal bars, said bars being substantially coplanar and intersecting one another at a central location with the opposed free ends of said first bar being connectable to said first movable body and with the opposed free ends of said second bar being connectable to said second movable body;

first means for rigidly connecting at least one free end of said first bar to said first movable body;

second means for rigidly connecting at least one free end of said second bar to said second movable body; and clamping means for securely fastening said bars at said central location, said clamping means being characterized by an inwardly flared portion at the periphery of said means near where said bars extend from said means, said bars being configured such that said linkage element is capable of motion in three axes whereby said linkage element provides support and torsionally restrained relative motion between said bodies in all axes.

8. A linkage element as recited in claim 7 wherein said bars are substantially in the shape of a rectangular solid.

9. A linkage element as recited in claim 7 wherein said lineal bars are substantially perpendicular to one another.

10. A linkage element as recited in claim 7 wherein said clamping means comprises a pair of clamp members disposed on each side of said lineal bars, each said clamp member having a pair of grooves for receiving said lineal bars.

11. A linkage element as recited in claim 10 wherein said clamp members are substantially cylindrically shaped.

* * * * *